US008142147B2

(12) United States Patent
O'Connor et al.

(10) Patent No.: US 8,142,147 B2
(45) Date of Patent: Mar. 27, 2012

(54) CENTRIFUGAL BLOWER WITH PARTITIONED SCROLL DIFFUSER

(75) Inventors: John F. O'Connor, New Hartford, CT (US); Roger B. Dickinson, Torrington, CT (US)

(73) Assignee: The Bergquist Torrington Company, Chanhassen, MN (US)

( * ) Notice: Subject to any disclaimer, the term of this patent is extended or adjusted under 35 U.S.C. 154(b) by 1022 days.

(21) Appl. No.: 12/100,063

(22) Filed: Apr. 9, 2008

(65) Prior Publication Data

US 2011/0280748 A1 Nov. 17, 2011

Related U.S. Application Data

(63) Continuation of application No. 10/080,200, filed on Feb. 19, 2002, now abandoned.

(60) Provisional application No. 60/270,932, filed on Feb. 26, 2001.

(51) Int. Cl.
*F04D 29/44* (2006.01)
*F04D 29/42* (2006.01)

(52) U.S. Cl. ..... 415/204; 415/206; 415/211.1; 415/211.2

(58) Field of Classification Search ..... 415/126–128, 415/204, 206, 211.1, 211.2; 416/185, 186 R, 416/187, 188, 3, 223 B, 241 A, 170 R; 417/353–354, 423.1, 423.7
See application file for complete search history.

(56) References Cited

U.S. PATENT DOCUMENTS

| | | | |
|---|---|---|---|
| 244,993 | A | 8/1881 | Gage |
| 1,889,816 | A | 12/1932 | White |
| 2,330,938 | A | 10/1942 | Williams |
| 3,313,342 | A | 4/1967 | Laing |
| 3,759,627 | A | 9/1973 | Ehlinger |
| 3,829,235 | A | 8/1974 | Woollenweber |
| 3,866,423 | A | 2/1975 | Benisek |
| 4,164,690 | A | 8/1979 | Muller et al. |
| 5,156,524 | A | 10/1992 | Forni |
| 5,597,034 | A | 1/1997 | Barker, III et al. |
| 5,782,605 | A | 7/1998 | Kohler |
| 5,979,541 | A | 11/1999 | Saito |
| 6,379,126 | B1 | 4/2002 | Konno |
| 6,499,954 | B1 | 12/2002 | Adonakis |

FOREIGN PATENT DOCUMENTS

| | | | |
|---|---|---|---|
| CH | 132105 | A | 6/1929 |
| JP | 55-66697 | A | 5/1980 |
| JP | 58-101297 | A | 6/1983 |
| JP | 58-217798 | A | 12/1983 |
| JP | 61-247889 | A | 11/1986 |

*Primary Examiner* — Christopher Verdier
(74) *Attorney, Agent, or Firm* — Haugen Law Firm PLLP

(57) ABSTRACT

A centrifugal blower having at least one radial plane dividing its scroll into sub-sections which may vary as to cut-off points and axial and radial dimensions as well as axial displacement to meet requirements of individual application system flow paths.

16 Claims, 6 Drawing Sheets

CENTRIFUGAL BLOWER WITH PARTITIONED SCROLL DIFFUSER

CROSS-REFERENCE TO RELATED APPLICATIONS

This is a continuation application of U.S. patent application Ser. No. 10/080,200 filed on Feb. 19, 2002 and entitled CENTRIFUGAL BLOWER WITH PARTITIONED SCROLL DIFFUSER, abandoned, which itself claims priority from U.S. Provisional Application 60/270,932 filed on Feb. 26, 2001 and entitled CENTRIFUGAL BLOWER WITH PARTITIONED SCROLL DIFFUSER, the contents of which being incorporated herein in their entirety.

BACKGROUND OF THE INVENTION

This invention relates to a partitioned scroll diffuser, designed to efficiently provide multiple flow paths from a single centrifugal impeller.

One of the challenges for a designer of centrifugal blowers is to provide a scroll diffuser which efficiently converts velocity pressure to static pressure and at the same time aligns discharge flow accurately with the system flow paths required in a particular application of the blower. Efficient alignment of the discharge flow with the required system flow paths is essential in achieving the desired performance in a small package with low noise characteristics.

In certain applications, aligning the discharge flow from the scroll diffuser requires multiple discharges or a "high aspect ratio" single discharge. To date, one of two scroll housing configurations has been employed. The first is a multiple guide vane arrangement in the scroll diffuser as illustrated in FIGS. 1*a*, 1*b*, and 1*c*. The second configuration employs multiple discharges from single plane symmetrical scroll diffusers, in some instances in combination with guide vanes, see FIGS. 2*a* and 2*b*. Efficiency of the impeller assembly is adversely affected along with excess noise generation in either of these configurations.

SUMMARY OF THE INVENTION

A general object of the present invention is to provide an improved scroll diffuser which overcomes the disadvantages of the aforesaid scroll diffusers, this result being achieved with a single centrifugal impeller.

In accordance with the present invention, at least one partition extending substantially in a radial plane is provided within the scroll diffuser of a centrifugal blower and has an inner opening receiving and having its edge in close proximity with the periphery of the centrifugal impeller. The partition serves to divide the scroll diffuser interior into at least two discrete axially adjacent flows for the discharge of air from the scroll section. More specifically, the scroll section of the impeller assembly is divided into at least two discrete scroll sub-sections in axially adjacent relationship and associated respectively with said at least two axially adjacent flows. The scroll sub-sections may provide for discharge openings which are axially and/or angularly displaced or the scroll sub-sections may be axially configured or displaced relative to each other to provide a common axially aligned discharge opening of increased length. Each scroll sub-section can be designed with its own expansion rate as required by discharge flow requirements and the scroll sub-section cut-offs can be rotated through an infinite number of angular positions while maintaining efficient impeller performance for each sub-section flow. It should be noted that prior art configurations require that scroll cut-offs be 180° apart to achieve reasonable efficiency in the absence of a vane diffuser as in FIGS. 2*a* and 2*b*

The design concept may be employed in any centrifugal blower assembly including but not limited to a forward curved impeller blade type, a backward inclined impeller blade, and a backward curved impeller blade. Plastic, metal or other construction is also accommodated. The number of radial plane partitions in the diffuser may vary as required. The axial width of each flow channel may also vary as well as the diffuser radial expansion angle and/or rate of expansion.

Benefits to the designer include allowing for variations in size and position of each housing discharge opening as the system application may require. Further, each scroll diffuser section may be designed to optimize the flow and pressure characteristics of the particular system flow paths involved. Benefits to the purchaser of the improved blower with partitioned scroll diffuser include a simple design versus multiple motorized impellers. The single impeller approach helps to reduce noise generation, lower power consumption, minimize space use, and increase reliability.

DESCRIPTION OF THE PREFERRED EMBODIMENTS OF THE INVENTION

FIGS. 1*a* through 2*b* illustrate various prior art designs employed in providing broad band and other discharge flow patterns primarily through the use of a plurality of vanes mounted in the scroll diffuser outlet section.

Figure 1A:
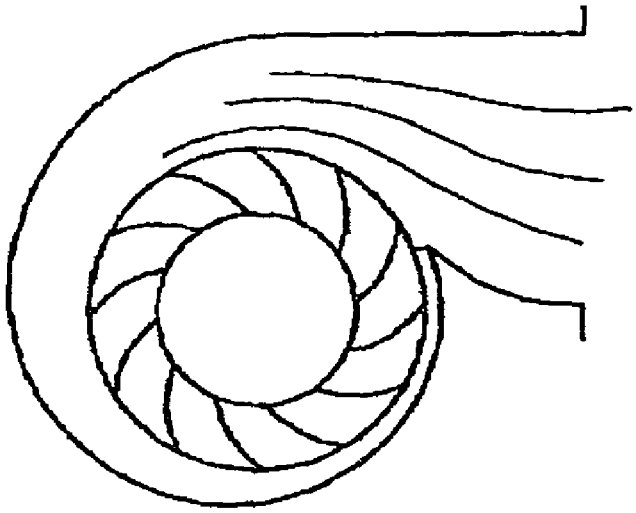
FIG. 1a (PRIOR ART)
FIG. 1*a* is a schematic view of a prior art centrifugal blower with vanes provided in the diffuser resulting in a broad band discharge flow equal to approximately the diameter of the impeller.
Figure 1B:
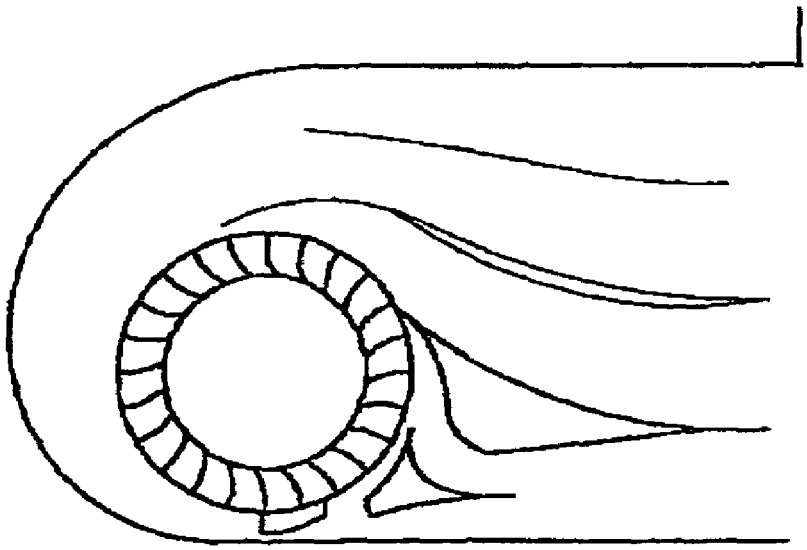
FIG. 1b (PRIOR ART)
FIG. 1*b* is a prior art schematic showing a centrifugal blower assembly provided with vanes resulting in a broad band discharge approximating twice the diameter of the impeller.
Figure 1C:
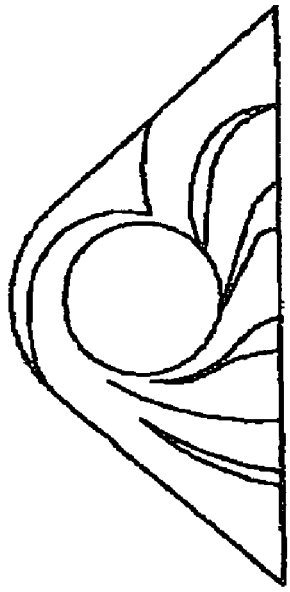
FIG. 1c (PRIOR ART)
FIG. 1*c* is a further prior art schematic showing a centrifugal blower assembly with outlet vanes resulting in a diameter approximating three diameters of an impeller wheel.
Figure 2A:
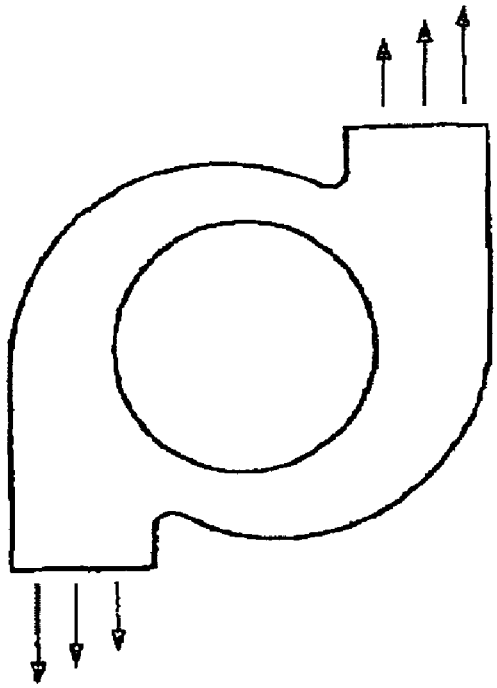
FIG. 2a (PRIOR ART)
FIG. 2*a* is a prior art schematic showing a centrifugal blower having discharge openings 180° opposed.
Figure 2B:
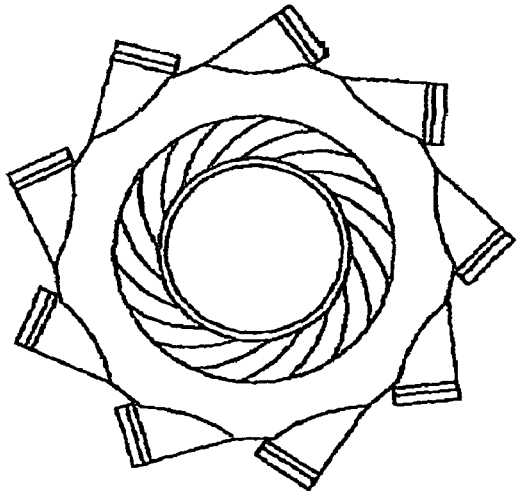
FIG. 2b (PRIOR ART)
FIG. 2*b* is a further prior art schematic showing a vane diffuser with multiple discharge flow paths.
Figure 3:
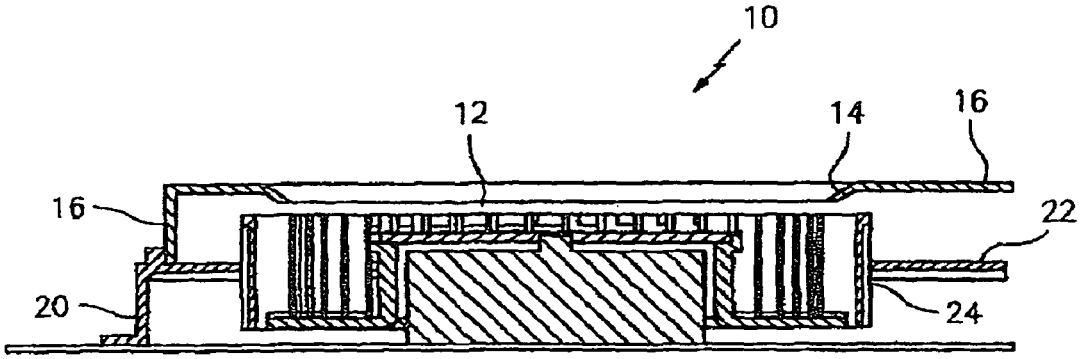
FIG. 3 is a sectional side view of a centrifugal blower constructed in accordance with the present invention and having a radial plane partition in the scroll section.
Figure 4:
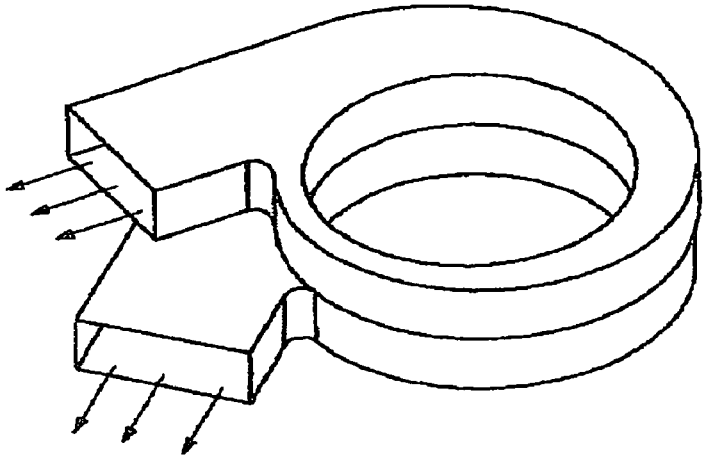
FIG. 4 is a perspective view of a centrifugal blower constructed in accordance with the present invention and having discrete angularly related discharge flows.

Referring particularly to FIG. 3, a centrifugal blower in accordance with the invention and indicated generally at 10 includes an impeller 12 which may take a conventional form and which receives inlet air axially through an opening 14 in an upper scroll sub-section 18. Upper and lower scroll sub-sections 18 and 20 are partially shown at the left-hand portion of the drawing. The scroll may be of metal or thermoplastic construction and includes a radial plane partition 22 mounted therewithin and which has a central opening 24 closely surrounding the periphery of the impeller 12.

Figure 5:
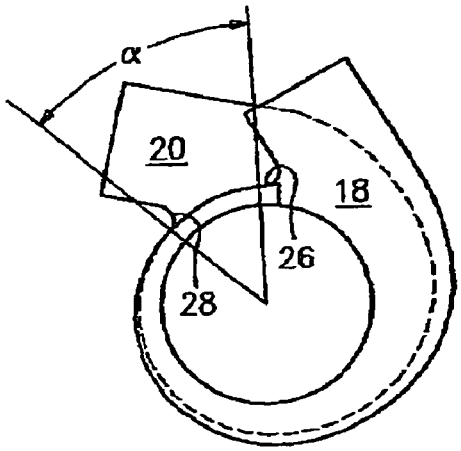
FIG. 5 is a schematic of the FIG. 4 blower assembly and illustrates the flexibility of the invention in providing for an infinite choice of scroll cut-off angles.
Figure 6:
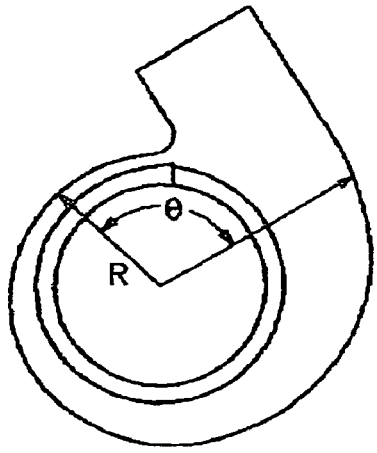
FIG. 6 is a schematic view of a centrifugal blower similar to FIG. 5 and illustrates the ability to provide for a variety of selected scroll expansion of dimensions as may be required for selected flow paths.

In accordance with the invention, the sub-sections 18 and 20 of the scroll are separated by the partition 22 and as illustrated in FIG. 5 are wholly independent of each other. Thus, the sections 18 and 20 may be designed with their cut-off points 26 and 28 angularly spaced apart circumferentially as shown. Similarly, the design of the sub-sections may have their expansion angles or rates wholly independent of each other. In FIG. 5, the radial expansion of the sub-sections 18 and 20 is substantially the same, but may vary substantially as will be seen hereinbelow.

Figure 7:
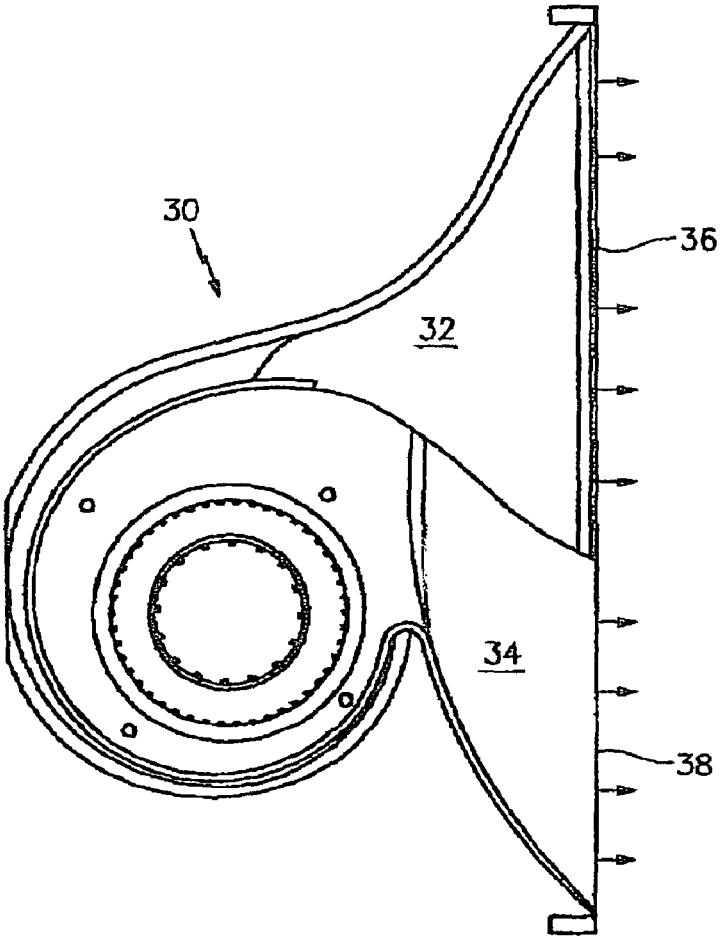
FIG. 7 is a schematic showing the arrangement of scroll sub-sections providing for an elongated aligned discharge flow.
Figure 8:
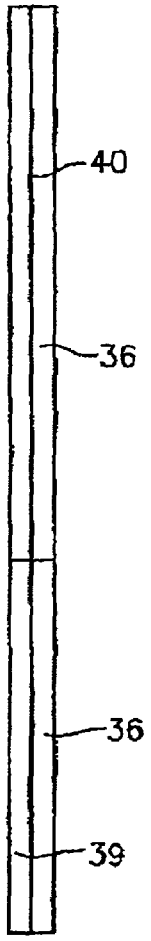
FIG. 8 is an end view of the schematic of FIG. 7.

FIG. 7 illustrates an impeller assembly 30 in accordance with the present invention and which has scroll sub-sections 32 and 34 which differ substantially with regard to their expansion rates. That is, the width of the scroll or the dimension from the impeller measured radially to the scroll sidewall varies substantially between scroll sub-sections 32 and 34. Further, the axial dimensions of the scrolls 32 and 34 may be varied and the scroll sub-sections may be progressively displaced bodily in an axial direction as they approach their respective discharge openings 36 and 38, each of which may be substantially rectangular. FIG. 8 illustrates the discharge openings 36, 38 from the front and it will be observed that the openings are aligned in end-to-end relationship with a common centerline 40, and a flow balancing restriction 39 in opening 38. Thus, a substantially elongated combined discharge opening is provided with the single impeller and discharge flow path requirements for the impeller are satisfied.

From the foregoing it will be seen that the scroll sub-sections may vary in axial dimension, radial dimension and the sections may also be bodily displaced axially relative to each other to provide an aligned elongated opening having a common centerline as in FIG. 8.

Figure 9:
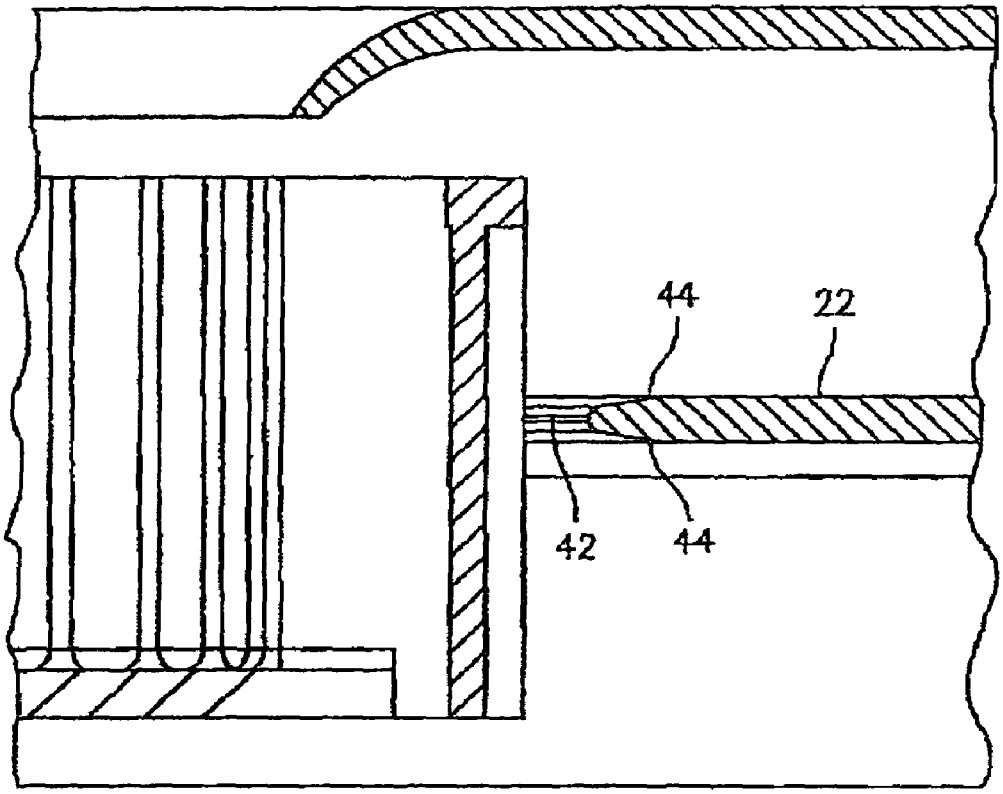
FIG. 9 is an enlarged sectional view showing the radial plane partition of FIG. 3.

FIG. 9 illustrates a preferred construction of the edge of the central opening in the radial partition 22. As will be seen, a rounded "bullet nose" leading edge is provided at 42 and gradually inclined sections 44, 44 extend outwardly therefrom to the full thickness of the partition. Efficient operation is achieved with this construction at low levels of noise generation.

Figure 10:
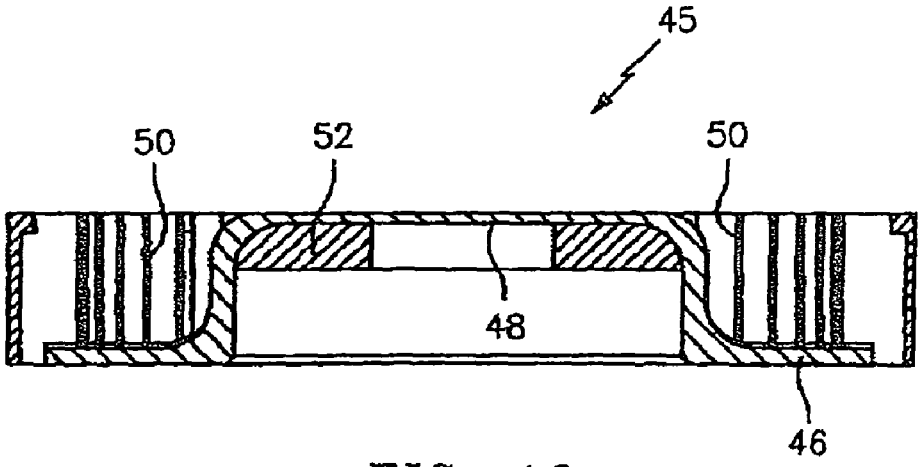
FIG. 10 is an enlarged sectional view of an impeller with a deep cup-shaped back plate.

In FIG. 10 an impeller 45, partially illustrated in cross-section, has a back plate with an outer annular portion 46 in a radial plane. A central section 48 of the back plate takes a cup-shape and resides within a central opening defined by impeller blades, 50, 50. The impeller blades 50, 50 are mounted at one end portion on the outer annular back plate portion 46 and extend therefrom with the central opening defined therewithin. At least a portion of an electric motor is mounted within the cup-shaped element 48 in the form of a permanent magnet 52. Preferably and as shown, the cup-shaped element 48 is of equal length with the blades 50, 50 to maximize the reduction in height of the overall assembly. This dimension is particularly important in applications of small centrifugal impellers for cooling purposes in electronic devices.

What is claimed is:

1. A centrifugal blower assembly comprising:

a centrifugal impeller adapted to receive air axially and discharge the same radially throughout an outer periphery;

an electric motor connected in driving relationship with the impeller;

a scroll diffuser defining a single axial inlet opening for supplying air to the impeller, and at least one scroll section for collecting and discharging air from the impeller, and at least one partition extending substantially in a radial plane mounted within the scroll section with an inner opening having an edge in close proximity to the periphery of the centrifugal impeller, said partition serving to divide the scroll section into at least two discrete axially separated flows for the discharge of air from the scroll section, each through a single discharge opening, said scroll section comprising at least two discrete scroll sub-sections associated respectively with said at least two axially separated flows, and each of said at least two scroll sub-sections being configured to provide different and independently optimized expansion angles.

2. A centrifugal blower assembly as set forth in claim 1, wherein said at least two scroll sub-sections have differing configurations of their outer walls.

3. A centrifugal blower assembly as set forth in claim 2, wherein the discharge openings of the at least two sub-sections are substantially rectangular in cross section and are arranged in adjacent end-to-end relationship to provide an elongated discharge opening.

4. A centrifugal blower assembly as set forth in claim 3, wherein the at least two scroll sub-sections are configured with varying axial dimensions and at least one scroll sub-section is displaced axially as it approaches its discharge opening to provide for an aggregate elongated discharge opening having substantially a common longitudinal centerline.

5. A centrifugal blower assembly as set forth in claim 2, wherein the discharge openings of the at least two sub-sections are arranged in adjacent side-by-side relationship to provide an aggregate discharge opening of substantially enlarged width.

6. A centrifugal blower assembly as set forth in claim 2, wherein the discharge openings of the at least two sub-sections are arcuately spaced apart from one another along a scroll path.

7. A centrifugal blower assembly as set forth in claim 1, wherein an axial dimension of at least a first one of said at least two scroll sub-sections varies as the air proceeds from the impeller to an associated discharge opening.

8. A centrifugal blower assembly as set forth in claim 7, wherein the axial dimension of said first one of said at least two scroll sub-sections varies differently than an axial dimension of a second one of said at least two scroll sub-sections.

9. A centrifugal blower assembly as set forth in claim 1, wherein respective centerlines of the flows through the at least two sub-sections differ.

10. A centrifugal blower assembly as set forth in claim 1, wherein said at least two scroll sub-sections have respective cut-off points substantially at the same point circumferentially along the periphery of the impeller opening in the partition.

11. A centrifugal blower assembly as set forth in claim 1, wherein said at least two scroll sub-sections have respective cut-off points spaced circumferentially from each other.

12. A centrifugal blower assembly as set forth in claim 1, wherein said at least two scroll sub-sections have discharge openings with respective centerlines that are substantially parallel to each other.

13. A centrifugal blower assembly as set forth in claim 1, wherein said at least two scroll sub-sections have discharge openings with respective centerlines that are angularly related to each other.

14. A centrifugal blower assembly as set forth in claim 1, wherein said edge of said inner opening in said partition has a thin rounded configuration facing the impeller.

15. A centrifugal blower assembly as set forth in claim 14, wherein said edge is inclined gradually outwardly on opposite sides from said rounded configuration to a full thickness of the partition.

16. A centrifugal blower assembly as set forth in claim 1, wherein a flow balancing restriction is incorporated in at least one of said at least two scroll sub-sections.

* * * * *